US011271296B2

(12) United States Patent
Stiborek et al.

(10) Patent No.: US 11,271,296 B2
(45) Date of Patent: Mar. 8, 2022

(54) MOLDED PACKAGED ANTENNA

(71) Applicant: TEXAS INSTRUMENTS INCORPORATED, Dallas, TX (US)

(72) Inventors: Leon Stiborek, Dallas, TX (US); Alexey Berd, Plano, TX (US); Daniel Lee Revier, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 588 days.

(21) Appl. No.: 16/181,627

(22) Filed: Nov. 6, 2018

(65) Prior Publication Data

US 2019/0148823 A1 May 16, 2019

Related U.S. Application Data

(60) Provisional application No. 62/612,278, filed on Dec. 29, 2017, provisional application No. 62/584,232, filed on Nov. 10, 2017.

(51) Int. Cl.

| | |
|---|---|
| ***H01Q 1/38*** | (2006.01) |
| ***H01Q 13/16*** | (2006.01) |
| ***H01Q 1/40*** | (2006.01) |
| *H01Q 1/24* | (2006.01) |
| *H01Q 9/04* | (2006.01) |

(52) U.S. Cl.

CPC ..... *H01Q 1/38* (2013.01); *H01Q 1/40* (2013.01); *H01Q 13/16* (2013.01); *H01Q 1/24* (2013.01); *H01Q 9/0421* (2013.01)

(58) Field of Classification Search

CPC ..... H01Q 1/38; H01Q 1/40; H01Q 13/16; H01Q 1/24; H01Q 9/04

USPC ..... 343/878

See application file for complete search history.

(56) References Cited

U.S. PATENT DOCUMENTS

| | | | | |
|---|---|---|---|---|
| 6,219,002 | B1 * | 4/2001 | Lim | H01Q 1/40 343/700 MS |
| 6,882,322 | B1 | 4/2005 | Apostolos et al. | |
| 9,397,727 | B1 * | 7/2016 | Mattsson | H04B 5/0031 |
| 2016/0190690 | A1 | 6/2016 | Badran et al. | |

FOREIGN PATENT DOCUMENTS

| | | | |
|---|---|---|---|
| CN | 105449356 | A | 3/2016 |
| GB | 2508428 | A | 4/2014 |
| JP | 2012253808 | A | 12/2012 |

OTHER PUBLICATIONS

International Search Report for PCT/US2018/060275 dated Sep. 21, 2019.

* cited by examiner

*Primary Examiner* — Andrea Lindgren Baltzell
(74) *Attorney, Agent, or Firm* — Valerie M. Davis; Charles A. Brill; Frank D. Cimino

(57) ABSTRACT

An antenna includes a metal member having a surface that includes a slot. The metal member includes a plurality of legs orthogonal to the surface of the metal member. The plurality of legs are configured to be attached to a circuit board. A first dielectric material is in the slot.

26 Claims, 4 Drawing Sheets

MOLDED PACKAGED ANTENNA

RELATED APPLICATIONS

This application claims priority to U.S. Provisional Application No. 62/584,232, filed Nov. 10, 2017, and U.S. Provisional Application No. 62/612,278 filed Dec. 29, 2017, which are hereby incorporated by reference.

BACKGROUND

Antennas are used in a variety of applications. For example, mobile electronic devices such as notebook computers, smart phones, tablet devices, and the like have one or more different types of radio transceivers. Examples of radio transceivers include Bluetooth transceivers, WiFi transceivers, etc.

SUMMARY

In one example, an antenna includes a metal member having a surface that includes a slot. The metal member includes a plurality of legs orthogonal to the surface of the metal member. The plurality of legs are configured to be attached to a circuit board. A first dielectric material is in the slot.

In another example, an apparatus includes a slot antenna having a metal member that includes a slot. The metal member includes a plurality of legs orthogonal to the surface of the metal member. The slot antenna includes a first dielectric material in the slot. A circuit board has a surface to which an electric component is attached. The plurality of legs of the slot antenna is attached to the surface of the circuit board. As attached, the slot antenna at least partially covers the electric component on the circuit board. The circuit board has no mold compound touching the circuit board.

BRIEF DESCRIPTION OF THE DRAWINGS

For a detailed description of various examples, reference will now be made to the accompanying drawings in which.

DETAILED DESCRIPTION

Figure 1:
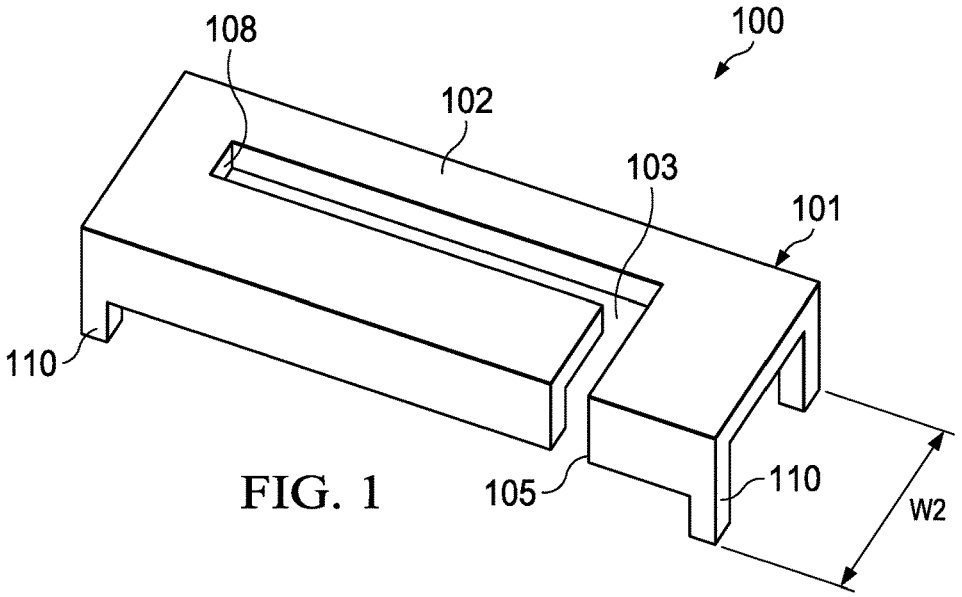
FIG. 1 illustrates a perspective view of a slot antenna in accordance with an example of the disclosure.

FIG. 1 shows an example of an antenna 100. The antenna 100 in FIG. 1 is a slot antenna, although other antenna configurations can be used as well. The antenna in FIG. 1 comprises a metal member 101. The metal member includes a top surface 102 that can be formed into various shapes. In the example of FIG. 1, the shape of top surface 102 is generally rectangular, but can comprise other shapes in other implementations. A slot is provided in the top surface 102 of the metal member 101. The shape and dimensions of the slot can be different for different applications but are generally selected for a given frequency or range of frequencies to which the antenna 100 is tuned. The slot 103 in the example of FIG. 1 is generally L-shaped between slot ends 105 and 108. The slot can be stamped or etched. Further, the slot can be C-shaped (or other shapes as well) instead of L-shaped. In general, the length of the slot should be less than a wavelength of the electromagnetic wave to be received or transmitted by the antenna. The slot creates two resonant structure, each at nominally a half-wavelength of the intended operating frequency. The metal member 101 includes multiple legs 110 that extend in a direction orthogonal to the top surface 102 of the metal member 101. The legs 110 are configured to attach the antenna 100 to a circuit board (e.g., a printed circuit board).

The disclosed antenna 100 also includes a dielectric material provided in the slot 103 of the metal member 101. The dielectric material may comprise any dielectric material that has a dielectric constant suitable to provide the antenna with the desired frequency response given the size and shape of the slot 103. In one example, the dielectric material comprises a mold compound. In other examples, the dielectric material comprises a ceramic material (e.g., boronitride or alumina).

FIGS. 2A-5B provide various examples of slot antennas with the dielectric material. In these examples, the antenna is formed a separate piece that has dielectric material filled in the slot of the antenna. The antenna integrated with the dielectric is then attached to a circuit board. The assembly of the circuit board and the antenna is not subsequently overmolded. That is, in some or all of these embodiments, no mold compound, or whatever dielectric is used to form the antenna, touches the circuit board. Because the circuit board itself is not over molded, technical challenges in overmolding an assembly in which small spaces (such as between the antenna and the circuit board) are avoided.

Figure 2A:
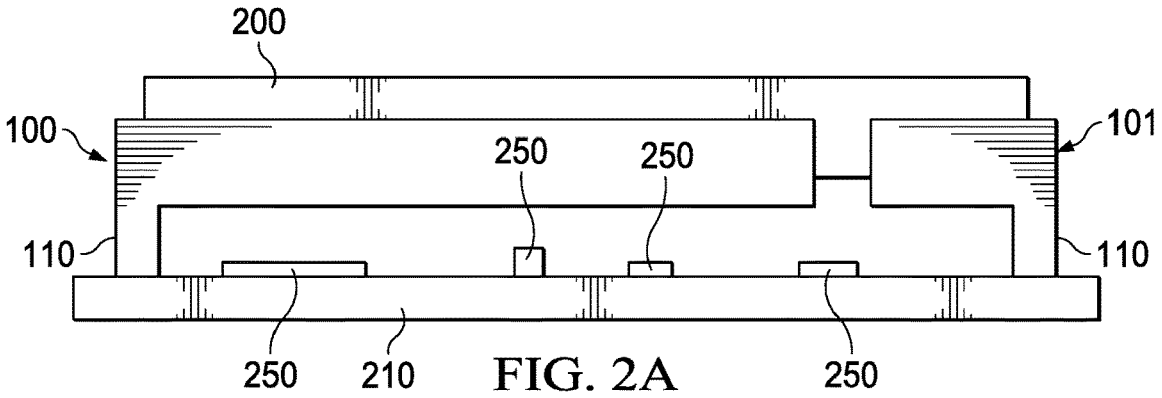
FIG. 2A shows side view of the slot antenna with dielectric material contained in the slot in accordance with one example.
Figure 2B:
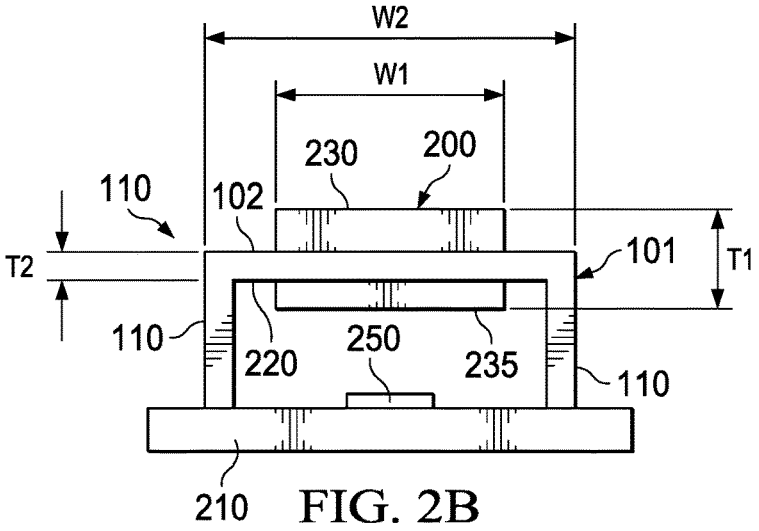
FIG. 2B shows an end view of the slot antenna of FIG. 2A.

FIG. 2A shows a side view of the antenna 100 attached to a circuit board 210 via legs 110. FIG. 2B shows an end view of the combination of the antenna 100 and circuit board 210. A dielectric material 200 is shown surrounding a portion of the top surface 102 and the bottom surface 220, opposite the top surface 102, of the metal member 101. As the slot 103 is formed from the top surface 102 to the bottom surface 220

(i.e., all the way through the metal member 101), the dielectric material 200 also fills the slot. The mold compound may initially be in pellet form. The mold compound is placed into a holder and melted and flowed into a mold chase that is designed to create the desired form (a process referred to as transfer molding). The temperature of the mold is elevated to, for example, 200 degrees Celsius as it is cured. The mold compound becomes thermoset which prevents the mold compound from again melting.

In the example of FIGS. 2A and 2B, the dielectric material 200 has an upper surface 230 and a lower (opposing) surface 235. Surface 102 of the metal member defines a plane that is between planes defined by surfaces 230 and 235 of the dielectric material 200. The upper surface 230 of the dielectric material 200 is planar in this example. Further, the opposing lower surface 235 of the dielectric material 200. The circuit board 210 includes one or more electrical components 250 (e.g., capacitor, semiconductor devices, etc.). The electrical components 250 may implement a radio transceiver such as for use, in conjunction with antenna 100, in sending and receiving Bluetooth transmissions, WiFi transmissions, etc. The antenna 100 at least partially, if not fully, covers the electrical components 250 on the circuit board 210. As such, the disclosed antenna 100 with dielectric integrated into the antenna functions as both an antenna for the underlying radio transceiver and as a shield for electromagnetic interference (EMI) from interfering with the radio transmissions received or transmitted by the radio transceiver.

The surface 102 of the metal member 101 is rectangular in the examples of FIGS. 1, 2A, and 2B and, as such, has a width W2. The metal member 101 has a thickness T2 between surfaces 102 and 220 (i.e., in a direction perpendicular to a plane defined by the surface 102). The dielectric material 200 in this example also has a width W1 and thickness T2 (also in the direction perpendicular to the plane defined by the surface 102). The thickness T1 of the dielectric material 200 in this example is greater than the thickness T2 of the metal member 101. Further, the width W1 of the dielectric material W1 is smaller than the width W2 of surface 101 in this example.

Figure 3A:
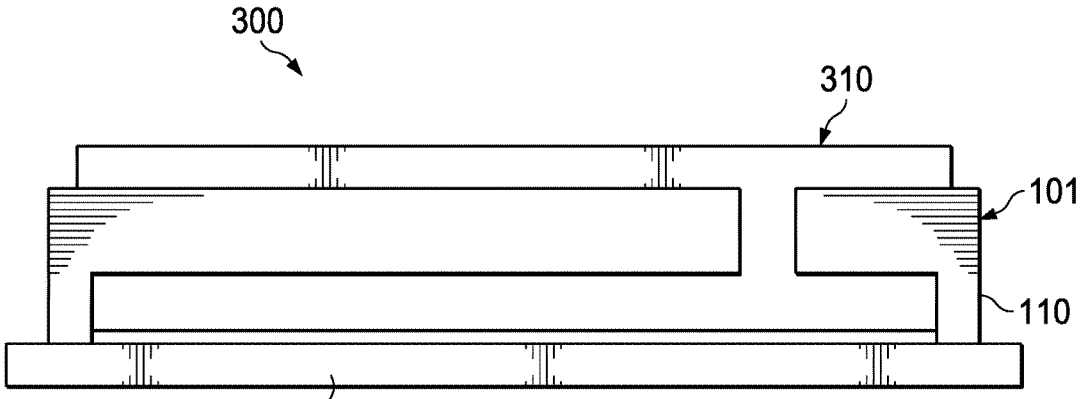
FIG. 3A shows side view of the slot antenna with dielectric material contained in the slot in accordance with another example.
Figure 3B:
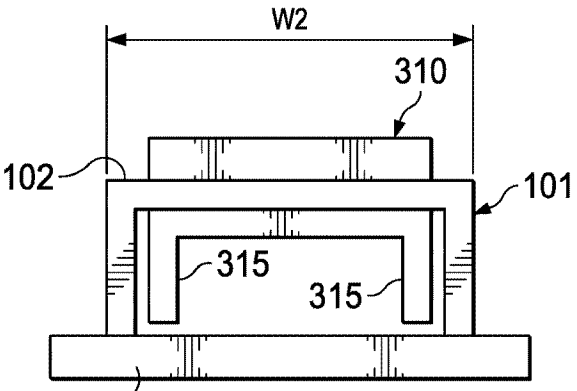
FIG. 3B shows an end view of the slot antenna of FIG. 3A.

FIG. 3A shows a side view of another example of an antenna-circuit board assembly 300. FIG. 3B shows an end view of the example of FIG. 3A. The metal member 101 of antenna is attached to circuit board 210. The dielectric material 310 in this example may comprise the same material as dielectric material 200 in FIGS. 2A and 2B. The dielectric material 310 in the example of FIGS. 3A and 3B include, not only dielectric material that fills the slot 103 of the metal member 101, but also dielectric portions 315 that extend in a direction from the surface 102 of metal member 101 towards the circuit board 210, and thus in a direction generally orthogonal to a plane defined by surface 102 of the metal member 101. The dielectric portions 315 provide an enclosed structure for the module to protect circuit components on the circuit board 210.

Figure 4A:
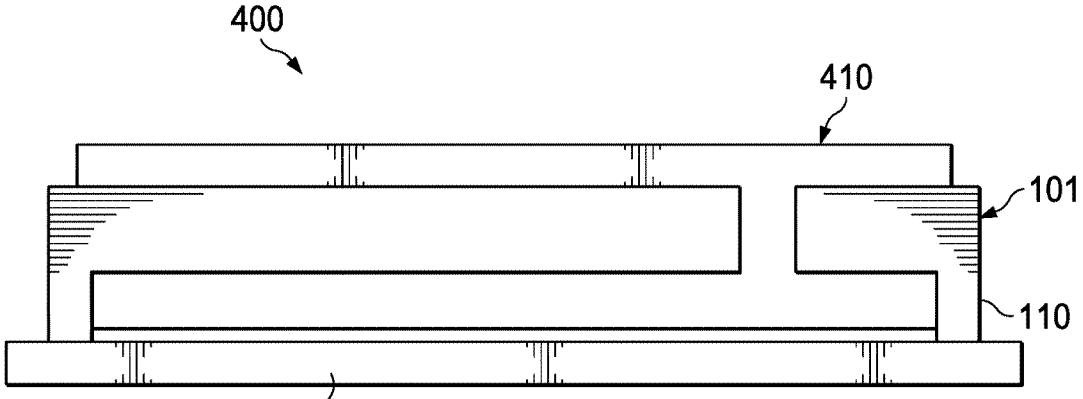
FIG. 4A shows side view of the slot antenna with dielectric material contained in the slot in accordance with another example.
Figure 4B:
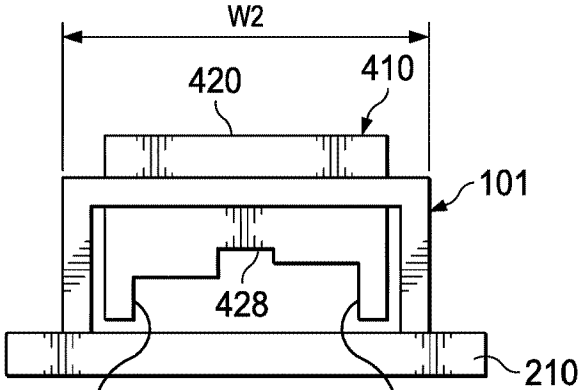
FIG. 4B shows an end view of the slot antenna of FIG. 4A.

FIG. 4A shows a side view of another example of an antenna-circuit board assembly 400. FIG. 4B shows an end view of the example of FIG. 4A. The metal member 101 of antenna is attached to circuit board 210. The dielectric material 410 in this example may comprise the same material as dielectric material 200 in FIGS. 2A and 2B. As for the example of FIGS. 3A and 3B, the dielectric material 410 in the example of FIGS. 4A and 4B include, not only dielectric material that fills the slot 103 of the metal member 101, but also dielectric portions 415 that extend in a direction from the surface 102 of metal member 101 towards the circuit board 210, and thus in a direction generally orthogonal to a plane defined by surface 102 of the metal member 101. The example of FIGS. 4A and 4B differ from that of FIGS. 2A-3B in that, while top surface 420 of the dielectric material 410 is generally planar, the bottom (opposing surface 428) is not planar. The topology of bottom surface 428 may coincide with the size and shapes of the electrical components 250 provided on the circuit board 210.

Figure 5A:
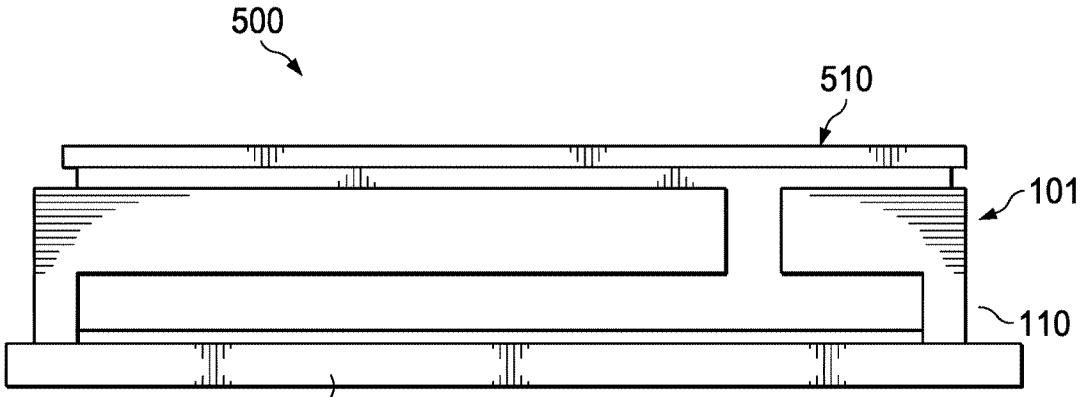
FIG. 5A shows side view of the slot antenna with dielectric material contained in the slot in accordance with another example.
Figure 5B:
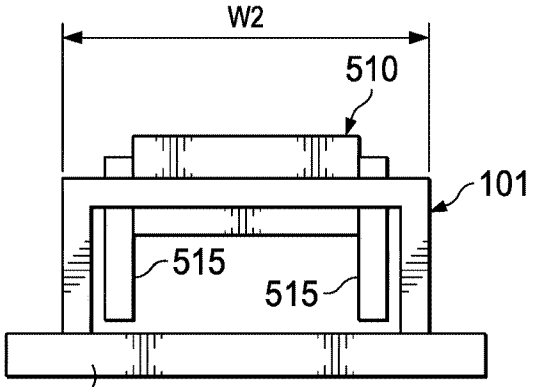
FIG. 5B shows an end view of the slot antenna of FIG. 5A.

FIG. 5A shows a side view of another example of an antenna-circuit board assembly 500. FIG. 5B shows an end view of the example of FIG. 5A. The metal member 101 of antenna is attached to circuit board 210. The dielectric material 510 in this example may comprise the same material as dielectric material 200 in FIGS. 2A and 2B. The dielectric material 510 in the example of FIGS. 5A and 5B include, not only dielectric material that fills the slot 103 of the metal member 101, but also dielectric portions 515 that extend in a direction from the surface 102 of metal member 101 towards the circuit board 210, and thus in a direction generally orthogonal to a plane defined by surface 102 of the metal member 101. The example of FIGS. 5A and 5B differ from that of FIGS. 3A-3B in the dielectric portions 315 comprise a different dielectric material as the dielectric material in the slot 103 of the metal member 101. For example, the dielectric constant of dielectric material in the slot 103 of the metal member 101 may be different from the dielectric constant of dielectric material portions 515. Different dielectric constants will change the radiation properties and frequencies of the antenna. These antenna properties may not be suitable for the semiconductor components or for thermal conductivity and thus different materials may be used.

Figure 6A:
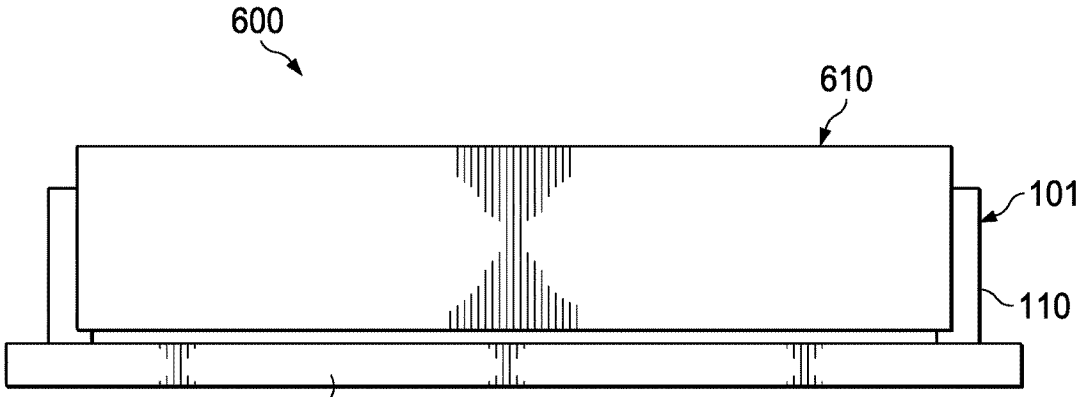
FIG. 6A shows side view of the slot antenna with dielectric material contained in the slot in accordance with another example.
Figure 6B:
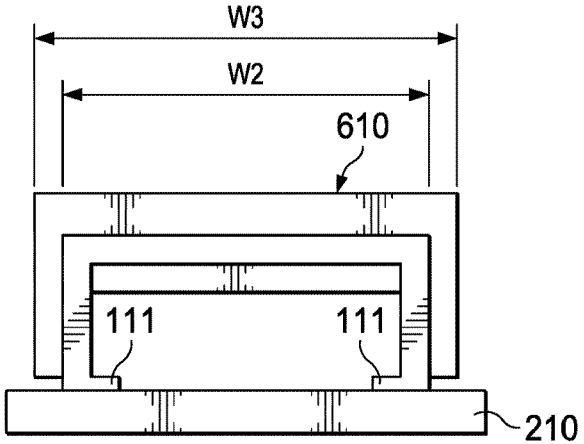
FIG. 6B shows an end view of the slot antenna of FIG. 6A.

FIGS. 6A and 6B show an example of an antenna-circuit board assembly 600 similar to that of the example of FIGS. 3A and 3B. The difference between the example of FIGS. 3A and 3B and between that of FIGS. 6A and 6B is that in FIGS. 6A and 6*b*, the width W3 of the dielectric material 610 is larger than the width W2 of the metal member 101. FIG. 6B also illustrates that the ends 111 of the legs 1110 of the metal member 101 are angled (e.g., bent) for attachment to the circuit board 210.

Figure 7A:
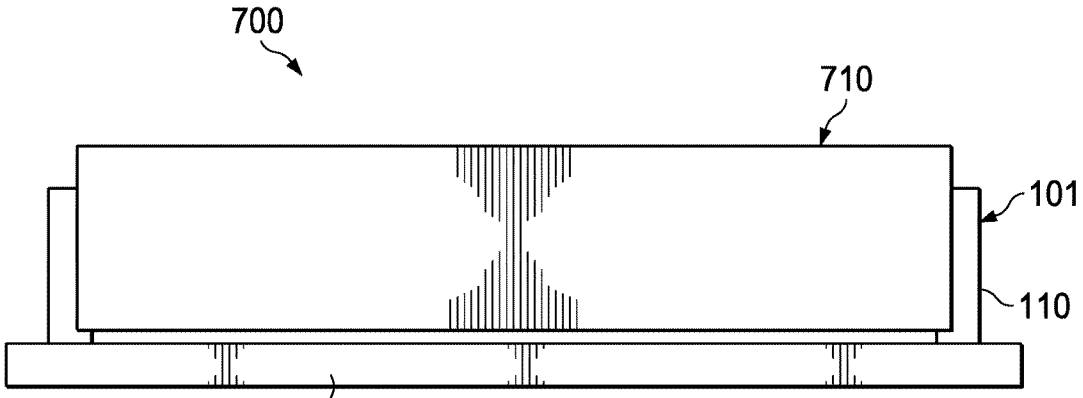
FIG. 7A shows side view of the slot antenna with dielectric material contained in the slot in accordance with another example.
Figure 7B:
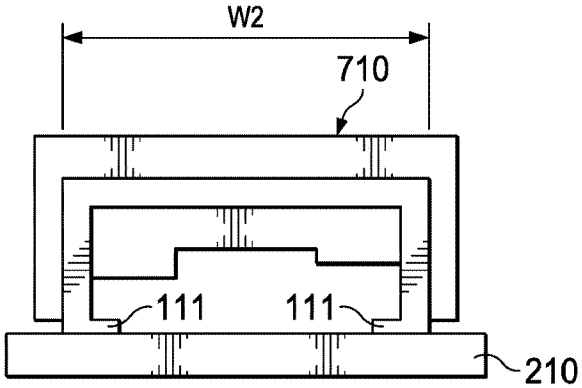
FIG. 7B shows an end view of the slot antenna of FIG. 7A.
Figure 8A:
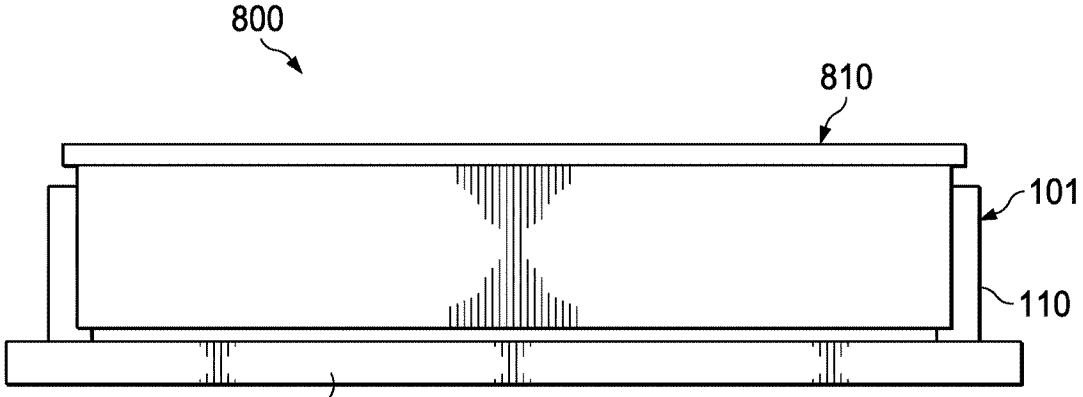
FIG. 8A shows side view of the slot antenna with dielectric material contained in the slot in accordance with another example.
Figure 8B:
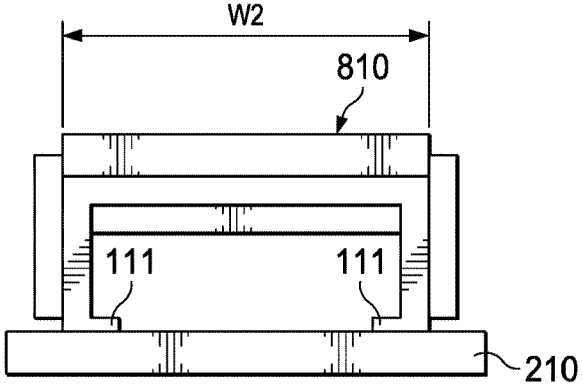
FIG. 8B shows an end view of the slot antenna of FIG. 8A.

Similarly, the example of FIGS. 7A and 7B matches that of the example of FIGS. 4A and 4B, but with the width of the dielectric material being greater than of the metal member as noted above for the example of FIGS. 6A and 6B. FIGS. 8A and 8B also match FIGS. 5A and 5B with the difference being that width of the dielectric material 810 is greater than of the metal member.

The above discussion is meant to be illustrative of various principles and examples. Modifications are possible in the described embodiments, and other embodiments are possible, within the scope of the claims.

What is claimed is:

1. An antenna, comprising:

a metal member having a surface that has a slot, the metal member including legs extending from edges of the surface of the metal member, the legs orthogonal to the surface, wherein the legs are configured to be attached to a circuit board; and a dielectric material in the slot.

2. The antenna of claim 1, wherein:

the metal member has a thickness in a direction perpendicular to a plane defined by the surface, the dielectric material has a thickness in the direction perpendicular to the plane defined by the surface, and the thickness of the dielectric material is greater than the thickness of the metal member; and the surface has a width, the dielectric material has a width, and the width of the dielectric material is smaller than the width of the surface.

3. The antenna of claim 1, wherein:

the metal member has a thickness in a direction perpendicular to a plane defined by the surface, the dielectric material has a thickness in the direction perpendicular to the plane defined by the surface, and the thickness of the dielectric material is greater than the thickness of the metal member; and the surface has a width, the dielectric material has a width, and the width of the dielectric material is greater than the width of the surface.

4. The antenna of claim 1, wherein:

the surface is rectangular with a length and a width;

the dielectric material has a width; and the width of the first dielectric material is smaller than the width of the surface.

5. The antenna of claim 1, wherein:

the dielectric material has a first surface and a second surface opposite the first surface;

the surface of the metal member is between the first and second surfaces of the dielectric material; and the first and second surfaces of the dielectric material are planar.

6. The antenna of claim 1, wherein:

the dielectric material has a first surface and a second surface opposite the first surface;

the surface of the metal member is between the first and second surfaces of the dielectric material; and the first surface is planar and the second surface is not planar.

7. The antenna of claim 1, wherein the dielectric material includes a portion that extends orthogonal to a plane defined by the surface of the metal member.

8. The antenna of claim 1, wherein the dielectric material is a first dielectric material, and the antenna further comprising a second dielectric material that extends orthogonal to a plane defined by the surface of the metal member, the first and second dielectric materials are different dielectric material.

9. The antenna of claim 1, wherein the dielectric material is a first dielectric material, and the antenna further comprising a second dielectric material that extends orthogonal to a plane defined by the surface of the metal member, the first and second dielectric materials have different dielectric coefficients.

10. An apparatus, comprising:

a slot antenna including: a metal member having a first surface that has a slot, the metal member including legs extending from edges of the first surface of the metal member, the legs orthogonal to the first surface; and a dielectric material in the slot; and a circuit board having a second surface and including an electric component attached to the second surface;

wherein the legs of the slot antenna are attached to the second surface, in which the slot antenna at least partially covers the electric component on the circuit board; and wherein the dielectric of the slot antenna does not touch the circuit board.

11. The apparatus of claim 10, wherein the metal member has a thickness in a direction perpendicular to a plane defined by the first surface, the dielectric material has a thickness in the direction perpendicular to the plane defined by the first surface, and the thickness of the dielectric material is greater than the thickness of the metal member.

12. The apparatus of claim 10, wherein:

the first surface is rectangular with a length and a width;

the dielectric material has a width; and the width of the first dielectric material is smaller than the width of the first surface.

13. The apparatus of claim 10, wherein:

the dielectric material has a third surface and a fourth surface opposite the third surface;

the first surface of the metal member is between the third and fourth surfaces of the dielectric material; and the third and fourth surfaces of the dielectric material are planar.

14. The apparatus of claim 10, wherein:

the dielectric material has a third surface and a fourth surface opposite the third surface;

the first surface of the metal member is between the third and fourth surfaces of the first dielectric material; and the third surface is planar and the fourth surface is not planar.

15. The apparatus of claim 10, wherein the dielectric material includes a portion that extends orthogonal to a plane defined by the first surface of the metal member.

16. The apparatus of claim 10, wherein the dielectric material is a first dielectric material, and the apparatus further comprising a second dielectric material that extends orthogonal to a plane defined by the first surface of the metal member, and the first and second dielectric materials are different dielectric material.

17. The apparatus of claim 10, wherein the dielectric material is a first dielectric material, and the apparatus further comprising a second dielectric material that extends orthogonal to a plane defined by the first surface of the metal member, and the first and second dielectric material have different dielectric coefficients.

18. An antenna, comprising:

a metal member having a surface that has a slot, the metal member including legs extending from edges of the surface, the legs orthogonal to the surface, and ends of the legs are a first distance from the surface; and a dielectric material having a first section on the surface of the metal member and one or more orthogonal sections including a first orthogonal section, the one or more orthogonal sections of the dielectric material each extend orthogonal to a plane defined by the surface of the metal member and each extend a respective distance from the surface that is less than the first distance, and the first orthogonal section extends into the slot.

19. The antenna of claim 18, wherein:

the metal member has a thickness in a direction perpendicular to a plane defined by the surface, the dielectric material has a thickness in the direction perpendicular to the plane defined by the surface, and the thickness of the dielectric material is greater than the thickness of the metal member; and the surface has a width, the dielectric material has a width, and the width of the dielectric material is smaller than the width of the surface.

20. The antenna of claim 18, wherein:

the metal member has a thickness in a direction perpendicular to a plane defined by the surface, the dielectric material has a thickness in the direction perpendicular to the plane defined by the surface, and the thickness of the dielectric material is greater than the thickness of the metal member; and the surface has a width, the dielectric material has a width, and the width of the dielectric material is greater than the width of the surface.

21. The antenna of claim 18, wherein:

the surface is rectangular with a length and a width;

the dielectric material has a width; and the width of the dielectric material is smaller than the width of the surface.

22. The antenna of claim 18, wherein:

the dielectric material has a first surface and a second surface opposite the first surface;

the surface of the metal member is between the first and second surfaces of the dielectric material; and the first and second surfaces of the dielectric material are planar.

23. The antenna of claim 18, wherein:

the dielectric material has a first surface and a second surface opposite the first surface;

the surface of the metal member is between the first and second surfaces of the dielectric material; and the first surface is planar and the second surface is not planar.

24. The antenna of claim 18, wherein the one or more orthogonal sections includes a second orthogonal section that extends along an outer surface of one of the legs.

25. The antenna of claim 18, wherein the dielectric material is a first dielectric material, and the antenna further comprising a second dielectric material that extends orthogonal to a plane defined by the surface of the metal member, the first and second dielectric materials are different dielectric material.

26. The antenna of claim 18, wherein the dielectric material is a first dielectric material, and the antenna further comprising a second dielectric material that extends orthogonal to a plane defined by the surface of the metal member, the first and second dielectric materials have different dielectric coefficients.

* * * * *